US005710479A

United States Patent [19]

Adriaanse et al.

[11] Patent Number: 5,710,479

[45] Date of Patent: Jan. 20, 1998

[54] COLOR DISPLAY TUBE COMPRISING AN IN-LINE ELECTRON GUN WITH ASTIGMATISM TUNING ELEMENT

[75] Inventors: Jan P. Adriaanse; Johannes H. Bohlander; Willibrordus A.J.A. Van Der Poel, all of Eindhoven, Netherlands

[73] Assignee: U.S. Phillips Corporation, N.Y., N.Y.

[21] Appl. No.: 582,007

[22] Filed: Jan. 2, 1996

[30] Foreign Application Priority Data

Jan. 13, 1995 [EP] European Pat. Off. ..... 95200070

[51] Int. Cl.[6] ..... H01J 29/46

[52] U.S. Cl. ..... 313/412; 313/414

[58] Field of Search ..... 313/412, 414, 313/449, 460

[56] References Cited

U.S. PATENT DOCUMENTS 4,583,024 4/1986 Chen ..... 313/414

4,626,738 12/1986 Gerlach ..... 313/414

5,517,078 5/1996 Sugawara et al. ..... 313/414

FOREIGN PATENT DOCUMENTS

0487139A1 5/1992 European Pat. Off. ..... H01J 29/56

0624894A1 11/1994 European Pat. Off. ..... H01J 29/50

*Primary Examiner*—Sandra L. O'Shea

*Assistant Examiner*—Vip Patel

*Attorney, Agent, or Firm*—Robert J. Kraus

[57] ABSTRACT

A colour display tube has an in-line electron gun for generating three co-planar electron beams first and second lens electrode produce a focusing lens field for focusing the electron beams. At least one of the lens electrodes has a correction element for tuning the astigmatism of the lens field. The correction element includes three co-linear apertures for passing the electron beams, the outer apertures of which are funnel-shaped, the wide end of the funnel-shape being directed away from the center aperture.

3 Claims, 4 Drawing Sheets

COLOR DISPLAY TUBE COMPRISING AN IN-LINE ELECTRON GUN WITH ASTIGMATISM TUNING ELEMENT

BACKGROUND OF THE INVENTION

The invention relates to a colour display tube comprising an in-line electron gun for generating three co-planar electron beams having a main lens structure comprising a first and second lens electrode for producing a focusing lens field for focusing the electron beams on a display screen, at least one of said lens electrodes having a correction element for adjusting the astigmatism of the lens field.

Such a colour display tube is known from European patent application No. EP-A- 0 487 139.

The lens field which is formed between the lens electrodes and which, in turn forms an electron optical lens may be astigmatic. As a result thereof, the electron beams may be astigmatically focused, i.e. when the electron beams are focused for instance in the one direction, they are out of focus in the another direction. To tune the astigmatism at least one of the lens electrodes comprises a correction element for adjusting astigmatism. The correction element known from EP-A- 0 487 139 comprises outer apertures in a plate-shaped pan which apertures generate in operation an electric field having a six-pole component to compensate aim for six-pole components in the main lens. The outer apertures are of a trapezoidal form.

The inventors have realized that, in general, correction elements influence more electron optical parameters then just the astigmatism. In particular the correction element influences the relation between core haze asymmetry (sometimes also called focus asymmetry) and beam displacement. Preferably the core haze asymmetry and the beam displacement are simultaneously zero.

For correction elements as shown in EP-A- 0 487 139 the relation between core haze asymmetry and beam displacement is such that for any practical design an appreciable mount of core haze asymmetry and/or beam displacement exist. EP-A-0 487 139 does not discuss core haze asymmetry or beam displacement.

SUMMARY OF THE INVENTION

It is an object of the present invention to provide a colour display tube of the type mentioned in the opening paragraph for which the relation between core haze asymmetry and beam displacement is improved.

For this purpose, the colour display device according to the invention is characterized in that the correction element comprises three co-linear apertures for passing the electron beams, the outer apertures being funnel-shaped, the wide end of the funnel-shape being directed away from the centre aperture.

For such forms the six-pole components of the outer apertures are shifted outwardly in respect of the quadrupole components of said apertures. As a result, the relation between core haze asymmetry and beam displacement is favourably changed in respect of the apertures shown in EP-A- 0 487 139, while still tuning of the astigmatism and compensation of six-pole components of the main lens is achievable.

BRIEF DESCRIPTION OF THE DRAWING

The invention will be explained in greater detail by means of several exemplary embodiments with reference to the accompanying drawings in which.

The figures are not drawn to scale, corresponding parts generally bearing the same reference numerals.

DESCRIPTION OF THE PREFERRED EMBODIMENTS

Figure 1:
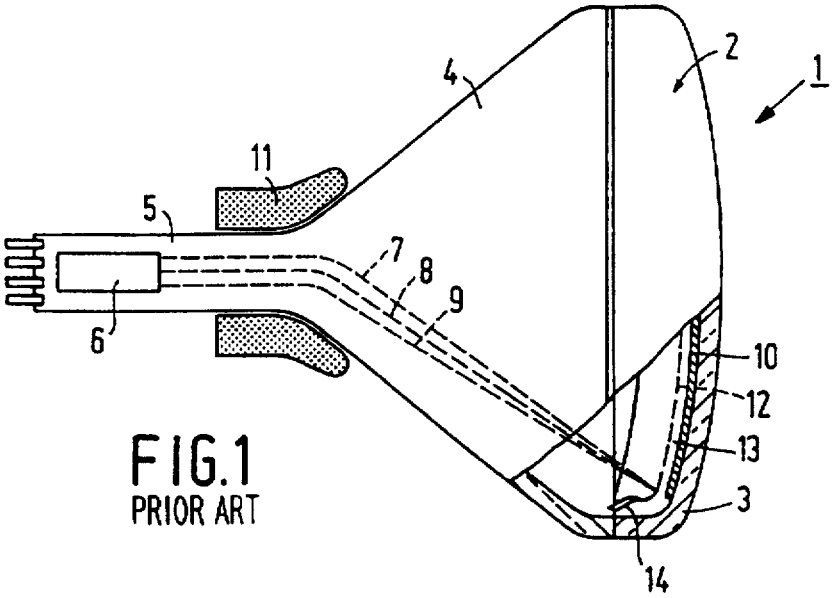
FIG.1 PRIOR ART
FIG. 1 is a sectional view of a colour display tube.

FIG. 1 is a sectional view of a colour display robe.

Colour display tube 1 comprises an evacuated envelope 2 which comprises a display window 3, a conical portion 4 and a neck 5. In the neck 5 there is provided an electron gun 6 for generating three electron beams 7, 8 and 9 which are located in one plane (when undeflected), the in-line plane, in this case the plane of drawing. A display screen 10 is provided on the inside of display window 3. The display screen 10 comprises a large number of phosphor elements luminescing in red, green and blue. The phosphor elements may be in the form of, for example lines or dots. On their way to the display screen 10 the electron beams 7, 8 and 9 are deflected across the display screen by means of a deflection unit 11 and pass through a colour selection electrode 12 which is arranged in front of the display screen 10 and which comprises a thin metal plate with apertures. The three electron beams pass through the apertures 13 in the colour selection electrode at a small angle to other and, consequently impinge each on phosphors of respective colour. The colour selection electrode is suspended by means of suspension means 14.

Figure 2:
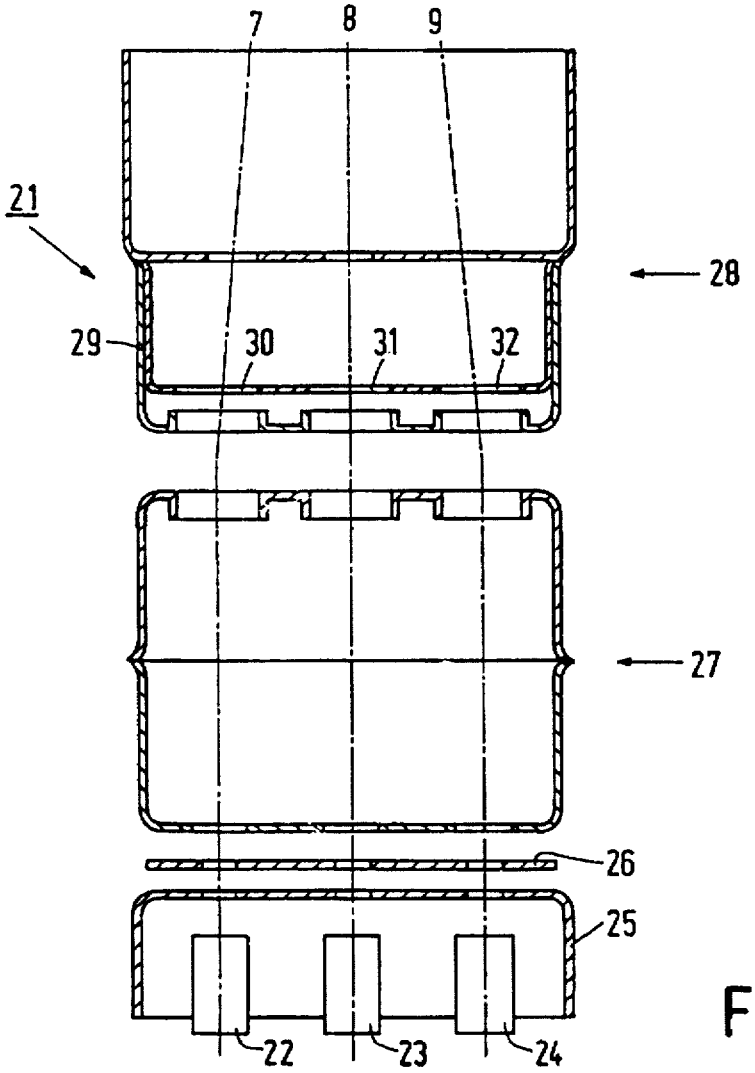
FIG. 2 is a sectional view of an electron gun having correction elements

FIG. 2 is a sectional view of an in-line electron gun having a correction element. The exemplary electron gun comprises three cathodes 22, 23 and 24 for emitting three co-planar electron beams 7, 8 and 9. The electron gun further comprises a first, common electrode 25 for the three electron beams, a second common electrode 26, a third joint electrode 27 and a fourth joint electrode 28. In operation, the electrodes 27 and 28 form an electron-optical field. Each of electrodes 27 and 28 each have three apertures for passing the respective electron beams. The electron-optical field focuses the electron beams on the display screen of the colour display tube. Electrode 28 comprises a correction element 29 having three apertures 30, 31 and 32.

Figure 3:
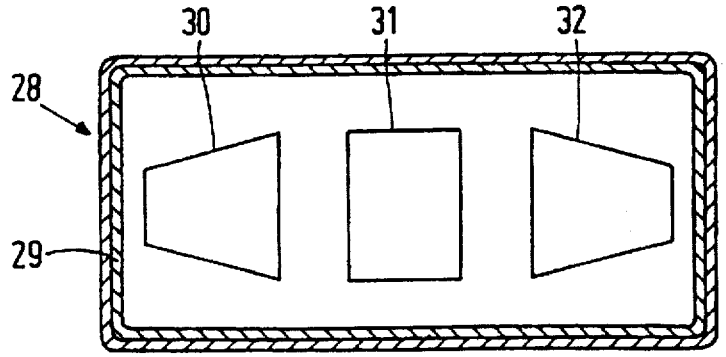
FIG.3 PRIOR ART
FIG. 3 is an elevational view of a correction element known from EP-A 0 487 139.

FIG. 3 shows a correction element as shown in EP-A 0 487 139. As explained in EP-A 0 487 139, such an insert can be used to tune astigmatism and compensate for unwanted six-pole components of the side holes of the G3 and G4 electrodes. Other effects are not discussed in EP-A 0 487 139.

Figure 4:
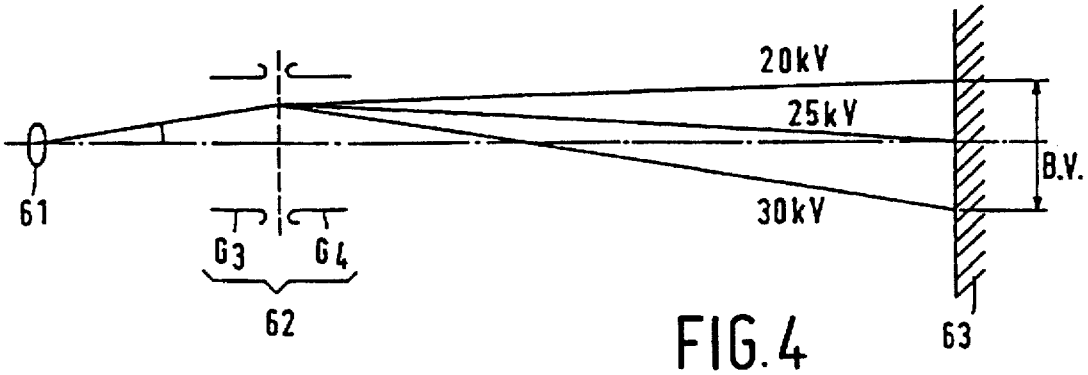
FIGS. 4 and 5 illustrate two effects which are also of importance for the quality of the tube, the so-called beam displacement (BD) and the core-haze asymmetry (CHA).

FIGS. 4 and 5 illustrate two effects which are also of importance for the quality of the tube, the so-called beam displacement (BD) and the core-haze asymmetry (CHA).

The main lens, in this example formed by electrodes G3 and G4, focuses the electron beams on the display screen. Errors may occur in this focusing operation. A first error is the so-called beam displacement. FIG. 4 schematically illustrates this error. In this example, the triode and the main lens are schematically indicated by lenses 61 and 62. In the event that the electron beam eccentrically enters the main lens, the position of the electron beam in the centre of the screen 63 changes, when the strength of the focusing lens is altered, for instance when the voltage on G4 is varied (the voltages on G3 remaining the same). The beam displacement BD is commonly measured as the difference in position of the electron beam on the screen 63, which occurs when the voltage on G4 is changed from 20 to 30 kV (kilovolts). The main reason why said beam displacement constitutes a problem is that the beam displacements of the outermost electron beams R and B are of opposite sign. Due thereto, a variation of the strength of the lens, for instance a variation of the voltage on G4, leads to red-blue convergence errors. In practice, a variation of the voltage on G4 of several kV may occur.

Figure 5A:
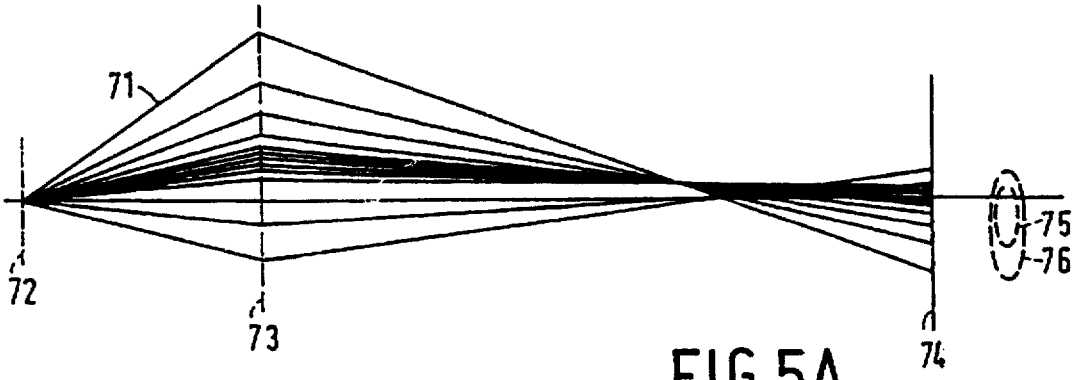
Figure 5B:
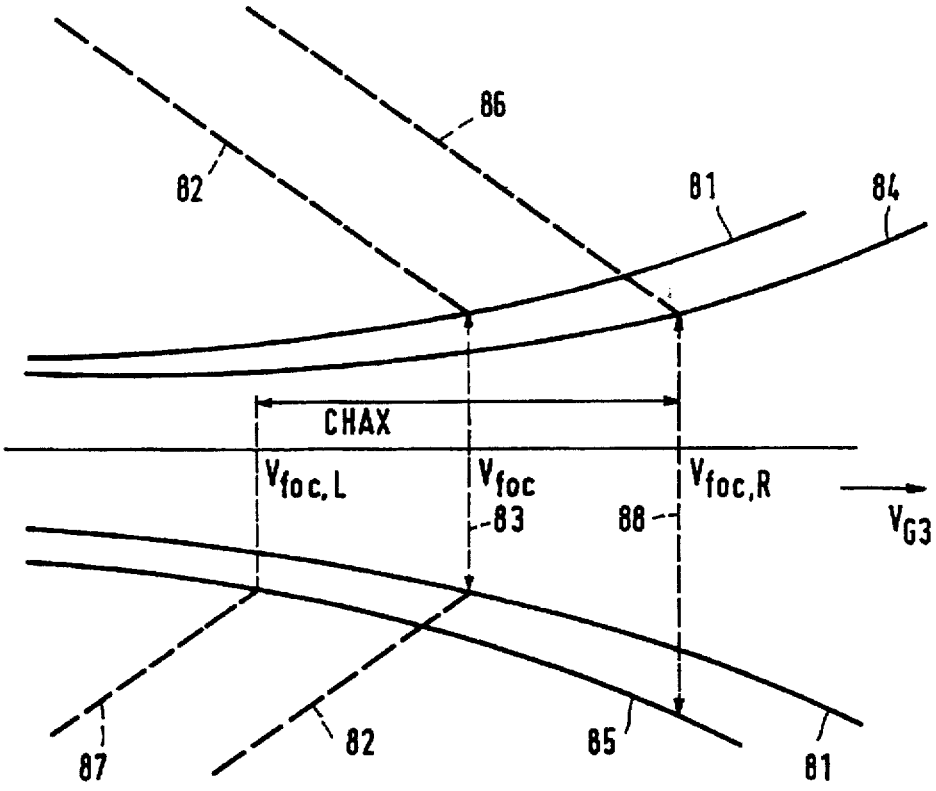

A second error is the so-called core haze asymmetry. FIGS. 5A and 5B schematically illustrate this effect. An electron beam 71 formed in triode portion 72 of the electron gun enters excentrically the main lens 73 and is focused on the screen 74. Spherical aberration of the lens causes the border rays to be more strongly deflected on one side than on the other side by the main lens, whereby an asymmetric haze 76 is formed around the core 75 of the electron spot. Such a haze leads to a reduced picture sharpness. The magnitude of this effect can be expressed as a potential difference, i.e. a difference between the potentials on G3, such that, for the centre of the display screen, the left-hand side of the core or the fight-hand side of the core are just free of haze. If this difference is approximately 0 volt, then the electron beam follows a so-called coma-free path through the main lens. The loss of sharpness is caused by the fact that, in practice, the highest voltage of the two focus voltages $V_{G3}$ is set. FIG. 5B illustrates the loss of sharpness. The voltage $V_{G3}$ is plotted on the horizontal axis. The edge of core 75 is shown on the vertical axis by means of solid lines; the edge of the haze 76 is shown by means of interrupted lines. At a high value of $V_{G3}$ no haze occurs. The solid lines 81 and the interrupted lines 82 represent the situation when there is absolutely no core haze asymmetry. If $V_{G3}<V_{foc}$ a haze occurs. In such a case, the voltage on G3 is adjusted so that $V_{G3}=V_{foc}$. The spot size is indicated by the length of arrow 83. Lines 84 and 85 represent the size of, respectively, the right-hand side and left-hand side of the core of the spot when core haze asymmetry occurs. Lines 86 and 87 represent the size of the haze, respectively, on the right-hand side and left-hand side of the spot. In this example, core haze asymmetry occurs because the haze on the right-hand side of the spot is larger than on the left-hand side of the spot. In this example, a haze occurs for the right-hand side of the spot if $V_{G3}<V_{foc,R}$ and for the left-hand side of the spot if $V_{G3}<V_{foc,L}$. The voltage on G3 is adjusted so that absolutely no haze occurs, i.e. $V_{G3}V_{foc,R}$. The spot size at this setting is represented by the size of arrow 88. It is obvious that the spot size has been enlarged with respect to the ideal size (no core haze asymmetry). The core haze asymmetry is defined by $V_{foc,R}-V_{foc,L}$=CHAX.

Figure 6:
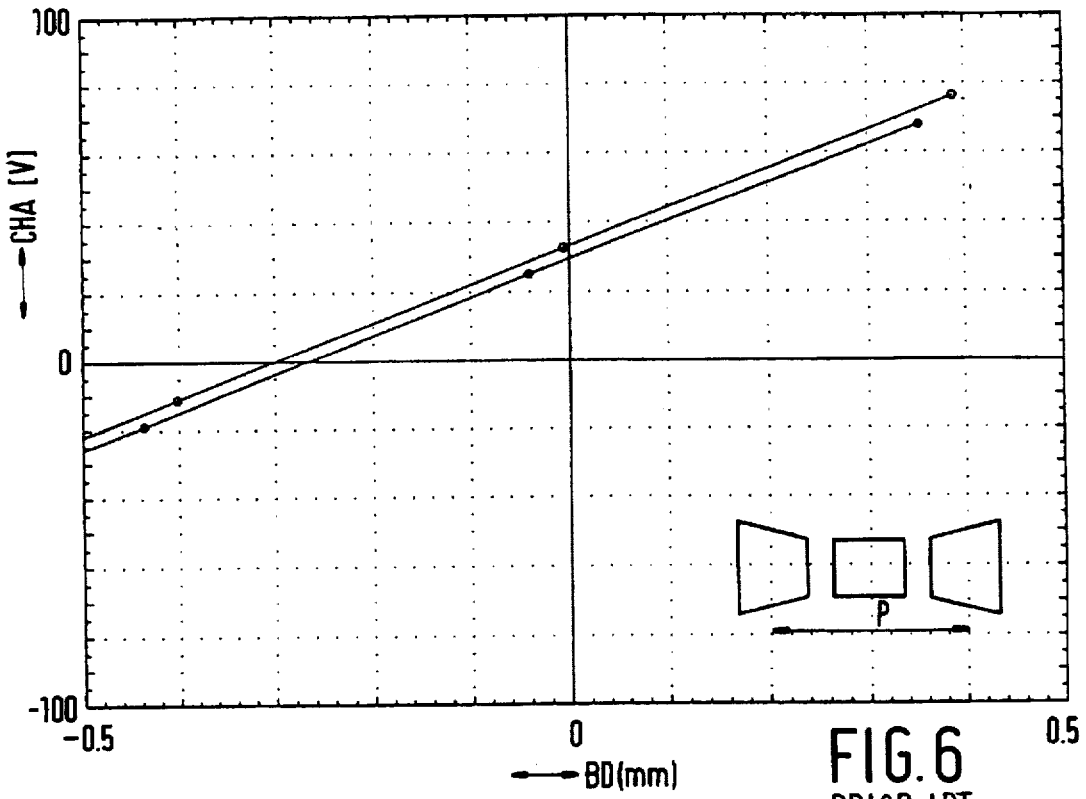
FIG. 6 PRIOR ART
FIG. 6 shows the relation between CHA and BD for a focusing lens having a known insert.
Figure 7:
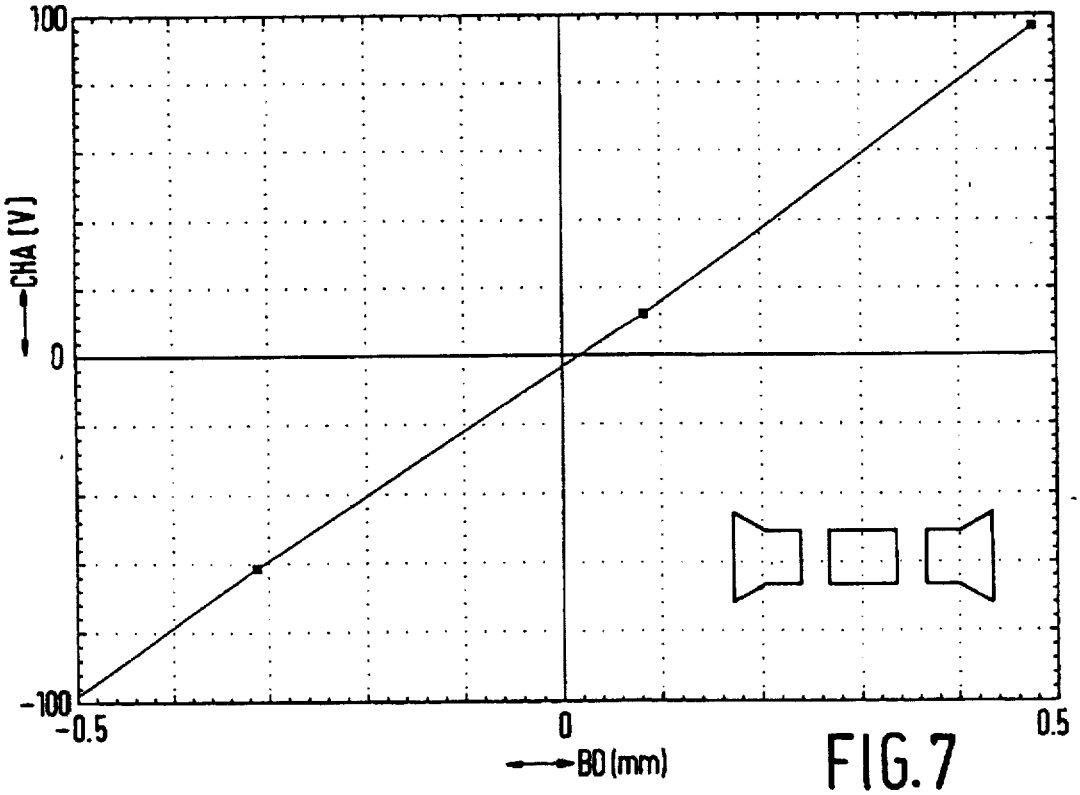
FIG. 7 shows the relation between CHA and BD for a focusing lens having correction element having trumpet-shaped outer apertures.

FIG. 6 shows the relation between core-haze asymmetry and beam displacement for a focusing lens having an insert as shown in EP-A 0 487 139 (the simple trapezoidal form of the outer apertures is shown in the fight hand lower corner of the graph). FIG. 7 shows the relation for two different pitches p.

For correction elements of the form shown in the right hand lower corner of FIG. 6 the relation between core haze asymmetry and beam displacement is such that for any practical design an appreciable amount of core haze asymmetry and/or beam displacement exist.

FIG. 7 shows the relation between CHA and BD for a correction element having trumpet-shaped outer apertures as shown in the right hand lower corner of said figure.

Figure 8:
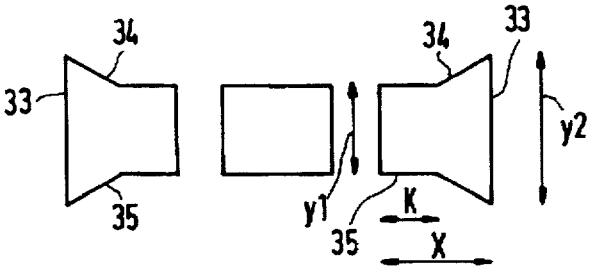
FIG. 8 is a top view of a correction element according to the invention.

FIG. 8 is a top view of a correction element according to the invention. The outer apertures are funnel shaped. In the frame of the invention "funnel-shaped" means that the outer apertures widen from the central aperture towards the outer edge 33 of the correction element wherein the upper and lower edges 34, 35 of the outer apertures are concave ("inwardly directed, hollow"). In common-day language such a form is usually called "funnel- or trumpet-shaped", where the wide end of the funnel is directed away from the central aperture. In the example shown in FIG. 8 the outer apertures are formed as hexagons. This is simple and easy to make shape. In this example the measurements y1, y2, x and k are approximately 3.9, 5, 5.5 and 2.75 mm respectively.

Figure 9:
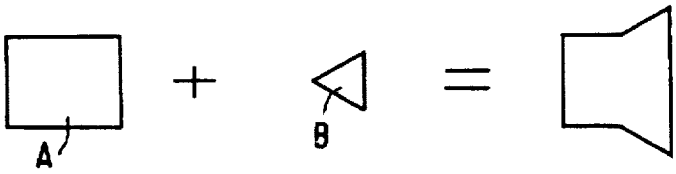
FIG. 9 shows diagrammatically the relative positions of components of the outer apertures.

The apertures in a correction element according to the invention can be considered to be constructed by a rectangular component and a triangular component. In the inventive correction element the rectangular component and the triangular component are shifted with respect to each other, the triangular component being shifted outwards in relation to the rectangular component. FIG. 9 shows diagrammatically the relative positions of these components. The outward shift of the triangular component (B) in respect of the rectangular component (A) means that the quadrupolar and the sextupolar field generated by the correction element are shifted with respect to each other. This shift enables an appreciable change of the CHA versus BD.

Figure 10A:
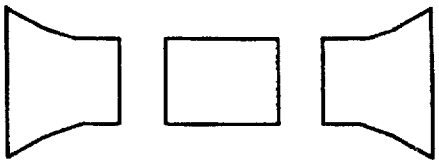
FIGS. 10*a* and 10*b* show further examples of funnel-shaped outer apertures.
Figure 10B:
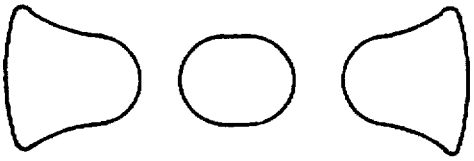

FIGS. 10A and 10B show further examples of funnel-shaped outer apertures. FIG. 10B shows a funnel-shaped aperture with rounded edges, FIG. 10A shows an octagon.

In summary, the present invention provides a colour display tube with an in-line gun having a main focusing lens with two electrodes each having three apertures for passing the electron beams, at least one of said electrodes having a correction element for correcting astigmatism thereby reducing the spread in astigmatism, said correction element having three apertures for passing the electron beams. The outer apertures are funnel—or trumpet-shaped, the wide end of the funnel or trumpet being directed away from the central aperture in the correction element. As a consequence the quadrupolar and sextupolar electrical fields generated by said correction element are shifted with respect to each other. Core haze asymmetry and/or beam displacement can thereby be reduced.

We claim:

1. A color display tube comprising a luminescent screen and an in-line electron gun for producing central and first and second outer electron beams, said electron gun including first and second electrodes for producing a main focusing lens field for focusing the electron beans at the screen, characterized in that at least one of the first and second electrodes includes a correction element for tuning astigmatism of the main focusing lens field to correct core haze asymmetry and beam displacement, said correction element comprising central and first and second outer apertures positioned for passing the respective electron beams, each of said first and second outer apertures being funnel shaped and including:

a. an inner area, closer to the central aperture, shaped for producing a quadrupole field component; and b. an outer diverging area, further from the central aperture, shaped for producing a six-pole field component.

2. A color display tube as in claim 1 where the first and second outer apertures are trumphet shaped.

3. A color display tube as in claim 1 where the first and second outer apertures are bell shaped.

* * * * *